United States Patent [19]

Bach et al.

[11] 4,049,209

[45] Sept. 20, 1977

[54] PROCESS AND DEVICE FOR FORMING A TRANSFER TAIL

[75] Inventors: Josef Bach, Leiterhofen; Horst Kollwig, Augsburg; Wolfgang Meitzner; Horst Weintritt, both of Bobingen; Ralf Ueberdiek, Augsburg, all of Germany

[73] Assignee: Hoechst Aktiengesellschaft, Frankfurt am Main, Germany

[21] Appl. No.: 652,495

[22] Filed: Jan. 26, 1976

Related U.S. Application Data

[63] Continuation of Ser. No. 478,277, June 11, 1974, abandoned.

[30] Foreign Application Priority Data

June 18, 1973 Germany ..... 2330961

[51] Int. Cl.[2] ..... B65H 54/34

[52] U.S. Cl. ..... 242/18 PW; 242/165

[58] Field of Search ..... 242/18 PW, 164, 165; 57/34 TT

[56] References Cited

U.S. PATENT DOCUMENTS

| | | | |
|---|---|---|---|
| 2,517,625 | 8/1950 | Bauer et al. | 242/18 PW |
| 2,630,976 | 3/1953 | Keight | 242/18 PW |
| 2,870,971 | 1/1959 | Keith | 242/18 PW |
| 3,198,445 | 8/1965 | Hull, Jr. et al. | 242/18 PW |
| 3,275,252 | 9/1966 | Bolger | 242/18 PW |
| 3,276,704 | 10/1966 | Pabis | 242/18 PW |
| 3,520,483 | 7/1970 | Swallow | 242/18 PW |
| 3,741,488 | 6/1973 | Wuest | 242/18 PW |
| 3,819,123 | 6/1974 | Luz | 242/18 PW |

*Primary Examiner*—Stanley N. Gilreath
*Attorney, Agent, or Firm*—Connolly and Hutz

[57] ABSTRACT

The present invention relates to a process and a device for forming a transfer tail on winding bobbins of high-speed winding frames by use of an auxiliary thread guide which is swivelled over a predetermined track at a predetermined speed and, subsequently, passes the yarn over to the reciprocating thread guide. It is possible to obtain a transfer tail of adjustable and reproducible length even at high winding speeds.

12 Claims, 2 Drawing Figures

FIG. 1
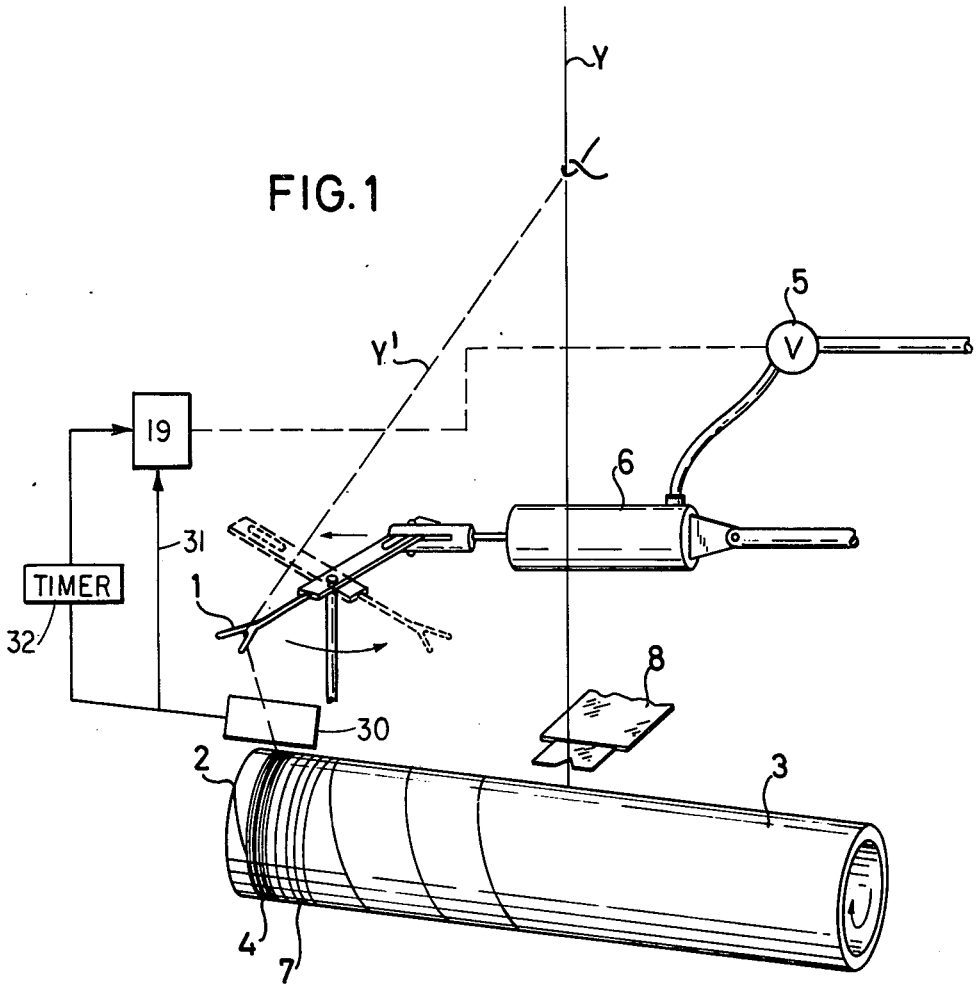
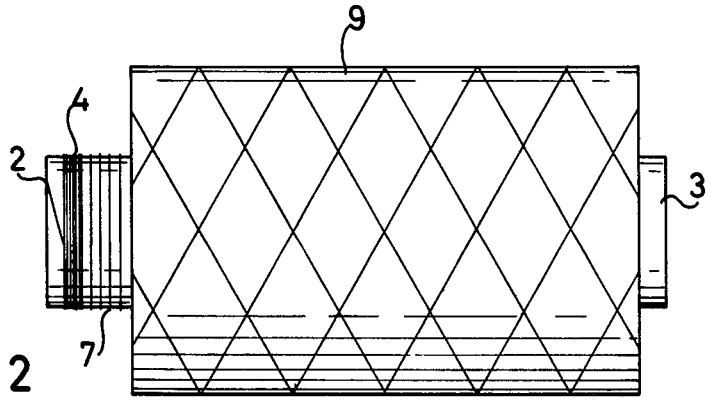
FIG. 2

PROCESS AND DEVICE FOR FORMING A TRANSFER TAIL

This application is a continutation of copending application Ser. No. 478,277, filed June 11, 1974, now abandoned by the same inventors.

The present invention relates to a process and device for forming a transfer tail on winding bobbins in the case of high-speed winding frames.

In order to permit a continuous production sequence it is necessary to provide thread bobbins and yarn bobbins with a transfer tail. The transfer tail allows the first-wound yarn end of a bobbin which is running down to be joined to the last-wound yarn end of the next bobbin. By a transfer tail there is understood the lower layers of a bobbin wound with yarn, which lie outside the normal build-up of the bobbin and must be accessible even in the case of a wound bobbin.

In winding frames, the yarn or the thread are in most cases caught on a driven empty bobbin, when starting up, by means of a catch slit or a notch provided at the edge of the bobbin, and is carried along by the bobbin. Depending on the construction of the transfer tail device, a greater or lesser waste ridge is thus produced on the empty bobbin since the yarn is not yet being reciprocated over the envisaged zone of the empty bobbin. The yarn is thereafter deflected from the position in which it strikes the bobbin to form the waste ridge and is taken over by the reciprocating thread guide, which permits building up the normal bobbin winding. Only the piece of yarn between the waste ridge and the proper winding is suitable for use as a transfer tail for piecing, if the yarn which forms the transfer tail has been wound onto the bobbin in simple parallel windings. For a trouble-free continuous production sequence when using the bobbins it is not only the free accessibility of the thread reserve but also its length which is of decisive importance. Given less than a minimum length, proper joining of the thread ends, which is in most cases carried out with the aid of so-called knotters, is no longer possible. If the transfer tail is of excessive length, the spare ends must be removed. The cut-off pieces of thread produced in this additional process step cause waste and possible soiling of the processing machines. To ensure optimum working, the converters of such bobbins demand transfer tails which have a quite specific length which must only deviate by a few centimeters from the nominal value demanded.

A series of suitable devices which are intended to produce a transfer tail has already been disclosed. However, these devices are not able to meet simply the demands made and in particular fail at high winding speeds and when winding non-twisted threads, the individual filaments of which exhibit only slight bonding.

It is known, for example, from German Offenlegungsschrift No. 2,118,886 to use empty bobbins which are provided with an external peripheral incision for receiving and fixing the transfer tail, this incision running, at least in part, helically and rising—in the winding direction—from the edge of the bobbin. Such empty bobbins can only be manufactured at great expense. In order to guide the yarn positively the peripheral incision must be made rather deep and this also increases the danger of damaging or tearing the yarns on winding or on taking the yarn from the transfer tail.

Whilst with ring spinning machines the transfer tail can be provided relatively simply by a suitable programme of travel of the ring rail, the use of auxiliary thread guides is customary in the case of winding frames. Thus, for example, German Auslegeschrift No. 1,710,113 corresponding to U.S. Pat. No. 3,730,447 describes a device on winding frames, for applying a transfer tail, with a separate reciprocating thread guide which moves the thread stepwise towards the middle whilst producing a few tightly adjoining windings and, for the actual build-up of the bobbin, passes the thread onto the self-threading reciprocating thread guide, with the stepwise further movement of the thread being effected by a guide plate provided with saw-tooth-like cams in conjunction with a lifting device which is mounted next to the reciprocating thread guide and has a sloping face, the lifting device lifting the thread during each reciprocating movement of the reciprocating thread guide and placing it in what is in each case the next valley between two teeth, in the direction of the center of the bobbin. With high-speed winding frames, this device does not produce a usable transfer tail and instead produces a series of small waste ridges, corresponding to the number of valleys between the teeth. It is practically impossible to make a perfect transfer tail from these thread ridges, for example manually, since the start of the yarn of each ridge forms the first layer on the empty bobbin and is covered by further turns of the yarn.

In French Pat. No. 2,109,460 an attempt has been made to overcome the disadvantage of discontinuous further movement, the yarn again being moved by a lifting device. However, the transverse stress as a result of the yarn sliding on the lifting device leads, in the case of non-twisted spun yarns, to splaying of the yarn, to damage to the filaments and hence to loop formation, fluff and thread breaks.

German Utility Model (Gebrauchsmuster.) No. 6,939,948 describes a device for laying-down a transfer tail located outside the winding zone at the bottom end of a winding empty bobbin, on a winding frame provided with a winding spindle and a thread guide, by using an auxiliary thread guide, the working zone of which adjoins, at the bottom of the winding empty bobbin, the reciprocating stroke zone of the thread guide, and which is driven by a screw drive as a function of the rotation of the winding spindle. With this device, the yarn is guided gently by the auxiliary thread guide, without any sideways sliding movement. Admittedly, the device requires great technical effort with regard to moving components and is correspondingly prone to breakdown. The guide thread can easily catch yarns or individual filaments and an open guide thread could even be regarded as an accident hazard. This device is not intended for high-speed winding processes and is only suitable for rewinding machines in which the thread can be threaded up with the winding frame not running.

Attempts are made - as described in German Offenlegungsschrift No. 2,042,674 corresponding to U.S. Pat. No. 3,792,818, to circumvent this high technical effort, and the associated proneness to break down by means of simple tilting levers as auxiliary thread guides. In this device, the sliding-over of the fed-in thread to the actual winding-up zone is delayed through the thread being guided via an auxiliary thread guide in the form of a tilting lever which—at least as a result of the inertia of the lever—causes delayed feed of the thread to the actual reciprocating thread guide. The sequence of motion of the tilting lever and hence the build-up of the transfer tail depends, with this device, very greatly on the yarn tension and on the frictional properties of the yarn on the surface of the tilting lever. There is no possibility of controlled setting of the build-up of the transfer tail, and of producing the transfer tail reproducibly.

It is therefore the task of the present invention to provide a simple process, which is reliable in operation, for forming an adjustable and reproducible number of yarn windings as a transfer tail outside the normal build-up of the bobbin on the empty bobbin, the process being particularly suitable for high-speed winding frames with continuous feed, also of non-twisted yarns such as are produced, for example, in a melt spinning installation.

The process according to the invention, and the device, are characterised in that the continuously supplied yarn is introduced into an initially static auxiliary thread guide and, after forming a small waste ridge on or outside the empty bobbin, the yarn is guided by this auxiliary thread guide over a predetermined swivelling track, at a predetermined speed, in the zone of the normal reciprocating stroke, so that the desired number of turns of yarn are formed as a transfer tail outside the normal reciprocating stroke, and that the yarn is then taken over by the normal reciprocating thread guide.

The yarn can, according to the invention, be guided by the auxiliary thread guide over any desired swivelling track; simple tracks, such as, for example, circles, are preferred, with the auxiliary thread guide being located at the end of a swivelling lever. The decisive characteristic of the invention is the forced guiding of the yarn by the auxiliary thread guide, which avoids splaying of the yarns. In a preferred embodiment, the swivelling lever of the auxiliary thread guide is caused to execute a defined movement by a hydraulic or pneumatic cylinder.

The motion of the auxiliary thread guide can be initiated, for example, manually by an operator. However, other types of initiation are equally preferred, such as, for example, by probes which record, for example, optically, the yarn which is passing or the yarn ridge which is forming, and thereupon initiate the movement of the auxiliary thread guide. The movement of the auxiliary thread guide and hence the formation of the transfer tail can, however, also be initiated, for example, by exceeding a predetermined limiting value of the yarn tension during the catching process.

The advantages of this invention become particularly obvious at winding speeds of, for example, more than 2,500 m/minute, where only $24 \times 10^{-3}$ sec. is available for forming a defined transfer tail of 1 meter length. With the previously known devices, the adjustable formation of a transfer tail of reproducible length within this short period of time has not been possible.

If the motion of the auxiliary thread guide according to the invention is initiated by a probe, it is possible largely to avoid the waste ridge which forms, that is to say, for example, to restrict it to about 1 yarn turn. This makes it unnecessary to remove the waste ridge, which has hitherto been necessary on further conversion of the bobbins.

The number of yarn turns which form the transfer tail is decided in accordance with the space situations on the empty bobbin and especially in accordance with the requirements for further processing. It is also possible first to wind some layers of yarn onto the empty bobbin by means of the reciprocating device, if this should be desired, and then again to remove the thread from the reciprocating thread guide, wind a waste ridge at the edge of the empty bobbin and then provide the transfer tail with the aid of the transfer tail device according to the invention and commence the actual winding process.

The attached drawings are intended further to explain the invention and to show a preferred embodiment.

FIG. 1A is a three dimensional diagrammatic view which shows, viewed at an angle, a winding frame with the transfer tail device according to the invention and FIG. 2 is a front view in elevation, which shows a bobbin such as is obtainable by the process according to the invention.

In FIG. 1, the continuously supplied yarn Y, such as is supplied, for example, by the take-off godets of a melt-spinning installation, is introduced by means of an aspirator, which is not shown, into the static fork-like auxiliary thread guide 1 and is then introduced into, and clamped in, the notch 2 of the rotating empty bobbin 3. The empty bobbin 3 is maintained in rotation by, for example, a drive roller which is not shown. The yarn Y which is supplied first forms the waste ridge 4 during which time the thread runs along the broken line Y'. The swivelling motion of the auxiliary thread guide 1 is then initiated via the throttle valve 5 and the piston 6.

Yarn sensor 30 provides an output 31 which is applied to an electrical control element 19, for example, a solenoid winding operatively connected to valve 5, to energize the control element 19 and move piston and thread guide 1 to the solid line position shown in FIG. 1. Simultaneously, a timer 32 is energized to time the wind-up of the yarn (assuming relatively constant speed thereof) so that the waste ridge 4 will accumulate. After this predetermined time has been counted, for example, several seconds, the timer 32 provides a pulse to the electrical winding 19 to actuate valve 5 to move piston and cylinder 6 to rotate thread guide 1 automatically at a predetermined angular speed to the phantom outline position shown in FIG. 1.

For example, at a winding speed of 3,000 m/minute a transfer tail 7 of 1 m length is formed in $20 \cdot 10^{-3}$ sec.; at an empty bobbin diameter of 80 mm this corresponds to 4 complete turns. Because of the thread tension, the thread jumps, after the swivelling motion of the auxiliary thread guide, into the position shown in broken lines in FIG. 1 and the yarn from the fork-like auxiliary thread guide is taken over by the self-threading reciprocating thread guide 8 which now provides the normal build-up of the bobbin. The auxiliary thread guide 1 subsequently again swivels out of the zone of the reciprocating stroke.

The reciprocating thread guide 8 accordingly has a planar operating zone having forward and reverse transverse limits. The auxiliary thread guide 1, therefore, carries the thread from outside of the reverse limit of the operating zone into the operating zone where it releases the thread to the reciprocating thread guide 8, which takes it over, and then the auxiliary thread guide 1 swivels out of the reciprocating operating zone of thread guide 8.

If the swivelling motion of the auxiliary thread guide follows a circular track, the plane of the circular track can be parallel to the axis of the bobbin, as is indicated in FIG. 1, or can be at an angle to this axis in order thus to lead the auxiliary thread guide out of the thread-travel plane of the reciprocating stroke when the yarn has been transferred to the reciprocating yarn guide.

FIG. 2 schematically shows the build-up of a bobbin obtained. On the empty bobbin 3 there is a notch 2 in which the thread to be wound up has been caught. First, the waste ridge 4 was formed, and after triggering the swivelling motion of the auxiliary thread guide the transfer tail 7 was formed, whilst subsequently the normal bobbin build-up 9 took place.

The advantages of the present invention can be seen particularly clearly from this example:

Without having to use special empty bobbins it is possible to form adjustable and reproducible transfer tails at high winding speeds and whilst feeding the yarn continuously. The length of transfer tail can be adjusted, without great effort, to suit the special requirements of the converter, for example by adjusting the throttle valve 5. It then remains preserved reproducibly for all winding processes. Fluctuations in thread tension or in the surface properties of the thread, such as can be caused, for example, by fluctuations in the application of a finish, produce no change in the form and length of the transfer tail.

The device according to the invention is technically simple and does not require any high-speed machine components; because of its simple construction it hardly requires any servicing and is sufficiently robust for factory use.

A further advantage of the invention is the forced guiding of the yarn by the auxiliary thread guide. Contrary to the known lifting devices for producing a transfer tail a splaying of the yarns was in no case observed with the process according to the invention. As a result of the forced guiding of the yarn it is furthermore not necessary to use high thread tensions for winding, and this proves to be a valuable help especially in the case of fine deniers.

What is claimed is:

1. A process for forming an adjustable and reproducible transfer tail of yarn wound on a winding bobbin on a high-speed winding frame having a reciprocating thread guide moving through a planar operating zone having forward and reverse traverse limits and an auxiliary rotatable thread guide having a substantial grooved recessed portion for releasably engaging the yarn, the auxiliary rotatable thread guide being initially engaged with the yarn outside of the forward traverse limit of the planar operating zone for holding it in position to form a waste ridge on the bobbin, the process comprising the steps of applying sufficient rotational force to the auxiliary thread guide to positively and automatically rotate it at a predetermined angular speed independent of fluctuations in yarn tension or in surface properties of the yarn whereby preselected turns of yarn are consistently wound as a transfer tail on the bobbin, and continuing rotation of the auxiliary thread guide to rotate the grooved recessed portion forward traverse limit end of the operating zone of the reciprocating thread guide, releasing the yarn from the recessed portion to transfer it at a predetermined coordinated speed to the reciprocating thread guide after the transfer tail is completed to permit the winding to then proceed without undue sliding between the yarn and thread guides to completion under control of the reciprocating thread guide whereby the stress and damage to the yarn is minimized.

2. A process as set forth in claim 1 wherein a fluid-operated force is applied to the auxiliary rotatable thread guide.

3. A process as set forth in claim 2 wherein the fluid-operated force is a pneumatically-operated force.

4. A process as set forth in claim 2 wherein the fluid-operated force is adjustable.

5. A device for forming an adjustable and reproducible transfer tail of yarn wound on a winding bobbin on a high-speed winding frame having a planar reciprocating thread guide moving through a planar operating zone having forward and reverse traverse limits comprising an auxiliary thread guide having a substantial grooved recessed portion for releasably engaging the yarn, rotatable bearing means mounting the auxiliary thread guide to rotate the substantial grooved recessed portion from positions outside of to positions just within the forward traverse limit of the operating zone and then past it to release the yarn to the reciprocating thread guide, drive means capable of applying a force to the auxiliary thread guide which rotates it at a predetermined angular speed when engaging the yarn in the substantial grooved recessed portion which speed is independent of fluctuations in yarn tension or surface properties of the yarn, whereby preselected turns of yarn are consistently wound as a transfer tail on the bobbin and the yarn is released without slippage to the reciprocating thread guide, and coupling means connecting the drive means to the auxiliary thread guide whereby the substantial grooved recessed portion may be moved from positions in front of the forward traverse limit of the operating zone to positions just within the forward traverse limit of the operating zone and past it whereby the yarn is transferred from the auxiliary to the reciprocating thread guide without slippage and whereby stress and damage of the yarn is minimized.

6. A device as set forth in claim 5 wherein the auxiliary thread guide comprises a forked lever having a forked end and the forked end comprises the substantial grooved recessed portion of the auxiliary thread guide.

7. A device as set forth in claim 6 wherein the coupling means is connected to the end of the forked lever remote from the fork.

8. A device as set forth in claim 5 wherein the drive means comprises a fluid-operated piston and cylinder.

9. A device as set forth in claim 8 wherein the fluid-operated piston and cylinder comprises a pneumatic piston and cylinder motor.

10. A device as set forth in claim 9 wherein a control valve is connected to the pneumatic piston and cylinder motor for adjusting the force applied thereby and the length of the transfer tail.

11. A process as set forth in claim 1 wherein the movement of the auxiliary rotatable thread guide is initiated by hand.

12. A process as set forth in claim 1 wherein the movement of the auxiliary rotatable thread guide is initiated automatically.

* * * * *